US009615684B2

(12) United States Patent
Deakin et al.

(10) Patent No.: US 9,615,684 B2
(45) Date of Patent: Apr. 11, 2017

(54) HAND HELD INSULATED BEVERAGE HOLDER WITH A PHONE COMPARTMENT

(71) Applicant: Archduke Enterprises, LLC, Brookfield, CT (US)

(72) Inventors: John Timothy Deakin, Brookfield, CT (US); Ralph Vincent Tremaglio, Brookfield, CT (US)

(73) Assignee: Archduke Enterprises, LLC, Brookfield, CT (US)

( * ) Notice: Subject to any disclaimer, the term of this patent is extended or adjusted under 35 U.S.C. 154(b) by 0 days.

(21) Appl. No.: 14/872,230

(22) Filed: Oct. 1, 2015

(65) Prior Publication Data

US 2016/0095457 A1 Apr. 7, 2016

Related U.S. Application Data

(60) Provisional application No. 62/059,241, filed on Oct. 3, 2014.

(51) Int. Cl.

| | |
|---|---|
| ***A45C 11/00*** | (2006.01) |
| ***A47G 23/02*** | (2006.01) |
| ***B65D 81/38*** | (2006.01) |
| ***A45F 5/00*** | (2006.01) |
| ***A45C 15/00*** | (2006.01) |

(52) U.S. Cl.

CPC ..... *A47G 23/0216* (2013.01); *A45C 11/00* (2013.01); *A45C 15/00* (2013.01); *A45F 5/00* (2013.01); *B65D 81/3876* (2013.01); *A45C 2011/002* (2013.01); *A45C 2200/20* (2013.01); *A45F 2200/0516* (2013.01); *A45F 2200/0583* (2013.01); *A47G 2023/0291* (2013.01)

(58) Field of Classification Search

CPC ... A47F 3/02; A47F 23/0216; B65D 81/3876; A45C 2011/002; A45C 2200/20

USPC ..... 220/739; 206/38

See application file for complete search history.

(56) References Cited

U.S. PATENT DOCUMENTS

| | | | |
|---|---|---|---|
| 2001/0032866 | A1 | 10/2001 | Gagne |
| 2002/0104845 | A1 | 8/2002 | Beuke |
| 2002/0113072 | A1 | 8/2002 | Lane |
| 2002/0166493 | A1 | 11/2002 | Sorensen |
| 2003/0089830 | A1 | 5/2003 | Loughman |
| 2003/0116465 | A1 | 6/2003 | Wilson, II et al. |
| 2003/0155786 | A1 | 8/2003 | Kim et al. |
| 2004/0084460 | A1 | 5/2004 | Scheetz, II et al. |
| 2004/0086112 | A1 | 5/2004 | Hilger et al. |
| 2004/0144904 | A1 | 7/2004 | Carnevali |
| 2004/0149765 | A1 | 8/2004 | Pryce |

(Continued)

OTHER PUBLICATIONS

Roethenbaugh, Gary, "The Runner from Clean Bottle offers smartphone holder", Feb. 24, 2012, http://www.triathlonbusiness.com/2012/industry-news/the-runner-from-clean-bottle-offers-smartphone-holder/

*Primary Examiner* — Anthony Stashick
*Assistant Examiner* — Raven Collins
(74) *Attorney, Agent, or Firm* — Ware, Fressola, Maguire & Barber, LLP

(57) ABSTRACT

A beverage holding and mobile device holding apparatus is provided. The apparatus includes a cylindrical housing formed from an insulating material and has flexible members attached to the cylindrical housing. A transparent member is attached to the flexible members to create a compartment which holds and allows use of the touch screen of a mobile device while in the compartment.

19 Claims, 10 Drawing Sheets

(56) References Cited

U.S. PATENT DOCUMENTS

2004/0173625 A1 9/2004 Jones
2004/0222345 A1 11/2004 Lindsay
2004/0232156 A1 11/2004 Hogan et al.
2005/0205739 A1 9/2005 DePue et al.
2005/0279751 A1* 12/2005 Dempsey ..... B65D 81/3876 220/739
2006/0075934 A1 4/2006 Ram
2006/0119233 A1 6/2006 Thomas
2006/0218690 A1 10/2006 James
2006/0240152 A1 10/2006 Krawzsenek
2006/0283868 A1 12/2006 McDonald, II
2007/0051735 A1 3/2007 Taylor et al.
2007/0158520 A1 7/2007 Fratianne
2007/0193908 A1 8/2007 Torchia et al.
2007/0267454 A1 11/2007 Baiz
2008/0047990 A1 2/2008 Morgan et al.
2008/0111038 A1 5/2008 Carnevali
2008/0128421 A1 6/2008 Ulbrand et al.
2008/0203127 A1 8/2008 Castillo-Garrison
2008/0245941 A1 10/2008 Schimmeyer
2009/0166139 A1* 7/2009 Cleary ..... A45C 13/02 190/111
2009/0189043 A1 7/2009 Schimmeyer
2010/0010599 A1 1/2010 Chen et al.
2010/0019115 A1 1/2010 Schimmeyer
2010/0078451 A1 4/2010 Mount
2010/0096396 A1 4/2010 Doig et al.
2010/0108755 A1 5/2010 Fuerstenberg et al.
2010/0155446 A1 6/2010 Stein et al.
2010/0294816 A1 11/2010 Sentell
2010/0301053 A1 12/2010 Willis et al.
2011/0127283 A1 6/2011 Delucia
2011/0185471 A1 8/2011 Buczkowski et al.
2011/0233155 A1 9/2011 Hui
2012/0067683 A1 3/2012 Cummins
2012/0074741 A1 3/2012 Andersson
2012/0104741 A1 5/2012 Brewster et al.
2012/0152782 A1 6/2012 Owens
2012/0193366 A1 8/2012 Miller
2012/0200501 A1 8/2012 Horvath
2012/0234846 A1 9/2012 Costanzo, Jr.
2012/0261408 A1 10/2012 White
2012/0280005 A1 11/2012 Myers et al.
2012/0285973 A1 11/2012 Hargett
2012/0325873 A1 12/2012 Stocco
2012/0330388 A1 12/2012 Chen et al.
2013/0012358 A1 1/2013 Lynn
2013/0020223 A1 1/2013 White
2013/0068804 A1 3/2013 Tweedie
2013/0098954 A1 4/2013 Inglis
2013/0119006 A1 5/2013 Graga et al.
2013/0119075 A1 5/2013 Justiss
2013/0126286 A1 5/2013 Chehebar
2013/0180683 A1 7/2013 Khan
2013/0319884 A1 12/2013 Gomez
2013/0334073 A1 12/2013 Frye
2014/0021207 A1 1/2014 Noble, Jr. et al.
2014/0061208 A1 3/2014 Boyd
2014/0087040 A1 3/2014 Vissman et al.
2014/0110413 A1 4/2014 Kelly et al.
2014/0116978 A1 5/2014 Khan
2014/0124632 A1 5/2014 Bouse et al.
2014/0131373 A1* 5/2014 Hiner ..... B65D 23/104 220/739
2014/0131530 A1 5/2014 Webb
2014/0252820 A1 9/2014 Botello et al.
2014/0263487 A1 9/2014 Conwell
2015/0069096 A1 3/2015 Kampas

* cited by examiner

HAND HELD INSULATED BEVERAGE HOLDER WITH A PHONE COMPARTMENT

CROSS-REFERENCE TO RELATED APPLICATIONS

The present application claims the benefit of U.S. Provisional Patent Application No. 62/059,241, filed Oct. 3, 2014, which is hereby incorporated by reference in its entirety.

BACKGROUND OF THE INVENTION

Hand held beverage holders known in the art allow a user to hold a beverage in a holder which can be held in one hand. However, such beverage holders restrict the user's use of that hand holding the beverage holder. The beverage holders are one dimensional. They hold only the beverage. As a result, they prevent a user from easily making a phone call on the user's mobile phone or access the applications on the user's mobile phone in the spare hand while holding the beverage holder in the other hand. The user of a conventional hand held beverage holder must put down his or her beverage to free their other hand for making a phone call or accessing the applications on the mobile phone. It is an object of the present invention to address these shortcomings in the art.

SUMMARY OF THE INVENTION

The present invention is a hand held insulated beverage holder with a mobile device compartment which allows the user to hold a beverage and a mobile device simultaneously in one hand and provide easy access to mobile device features through a clear pocket or compartment with the user's other available hand. The mobile device compartment has a clear front which allows the user to hold and drink the beverage, view and utilize mobile device screen, access the applications or make a phone call. The flexible and snug compartment allows the user to drink the beverage while the mobile device is safely in the compartment. While holding the beverage in the beverage holder, the invention enables the mobile device and the touchscreen to be accessible, useable and viewable while securely positioned in the beverage holder.

The individual components that form the preferred embodiment of the apparatus include an insulated beverage holding material forming a cylindrical housing, a stretchable attachment material forming elastic members, and a transparent protective material forming a transparent, sleeve member. To assemble the apparatus, the insulated beverage holding material is cut in one or more pieces to fit a typical beverage can, bottle or glass. The clear protective material is connected to the stretchable attachment material which is then attached to the pre-cut insulated beverage holding material to create the mobile device compartment.

According to a first aspect of the invention, a beverage holding apparatus is provided. The apparatus includes a cylindrical housing configured to receive a cylindrical container. A first elastic member is secured to the cylindrical housing along a first edge of the first elastic member, and at least a second elastic member is secured to the cylindrical housing along a first edge of the second elastic member. A transparent member having a first edge is secured to a second edge of the first elastic member and a second edge of the transparent member is secured to a second edge of the at least second elastic member. A compartment is formed between the transparent member and the cylindrical housing that is configured to expand away from the cylindrical housing by extending the elastic members, and the compartment is configured to receive a mobile device. The transparent member is formed from a transparent plastic material configured to permit operation of a touch screen on the mobile device positioned beneath the transparent material by a user making contact with the transparent material. According to one embodiment, the cylindrical housing also has a base section configured to cover one round end of the cylindrical housing According to a further embodiment of the apparatus of the first aspect of the invention, the transparent member comprises a sealing element configured to seal a third, base edge of the transparent member to secure the mobile device in the compartment. According to one embodiment, the sealing element is a third elastic member attached to the transparent member on one edge and attached to the cylindrical housing on another edge. The elastic member can be attached to the base section of the cylindrical housing. According to another embodiment, a first sealing element is provided on the transparent member and the cylindrical housing comprises a second sealing element. The two sealing elements are configured to mate. The second sealing element is arranged on the base of the cylindrical housing or on an interior surface of the cylindrical housing. The first and second sealing elements may comprise corresponding hook and loop fasteners.

According to a further embodiment of the beverage holding apparatus of the first aspect of the invention, the apparatus is collapsible to a substantially flat arrangement. Further, the cylindrical housing can be formed from a flexible, temperature insulating material. The first and second elastic members are formed from a highly flexible synthetic material that is different from the flexible, temperature insulating material forming the cylindrical housing.

According to a further embodiment of the apparatus of the first aspect of the invention, the cylindrical housing is formed from a single sheet of a flexible, temperature insulating material folded and seamed together by two side seams to form a cylindrical shape. According further to this embodiment, the first and second elastic member can be attached to the cylindrical housing by the two side seams or by additional seams.

According to a further embodiment of the apparatus of the first aspect of the invention, the apparatus comprises a neck section projecting from the cylindrical housing having a minimum diameter less than a diameter of the cylindrical housing.

According to a further embodiment of the apparatus of the first aspect of the invention, the cylindrical housing is formed in part by an insulating material and in part by a more flexible elastic material.

According to a second aspect of the invention, a method is provided for creating a beverage and mobile device holding apparatus. The method comprises attaching a first edge of a transparent member to a first elastic member and attaching a second edge of the transparent member to a second elastic member. A piece of temperature insulating material is folded and the transparent member and first and second elastic members are positioned inside the folded temperature insulating material. The transparent member and first and second elastic members are attached to the temperature insulating material. The folded piece of temperature insulating material is sealed on at least two edges providing a side seam through each of the at least two edges. The sealed temperature insulating material is inverted to provide a cylindrical housing configured to receive a container and an expandable compartment configured to receive a mobile device between the transparent member and the cylindrical housing. The transparent member and first and second elastic member are attached to the temperature insulating material by providing the side seams also through each of the elastic members, with one elastic member being arranged on each of the at least two edges of the temperature insulating material.

According to a further embodiment of the method, a third elastic member is provided and attached to a third base edge of the transparent member and attached to the temperature insulating material.

In an embodiment, the piece of insulating material can be in the shape of two rectangular portions separate by a round or rectangular base section, which is folded along the center of the base, and the rectangular portions are attached to each other by side seams after folding.

DETAILED DESCRIPTION OF THE INVENTION

Figure 1:
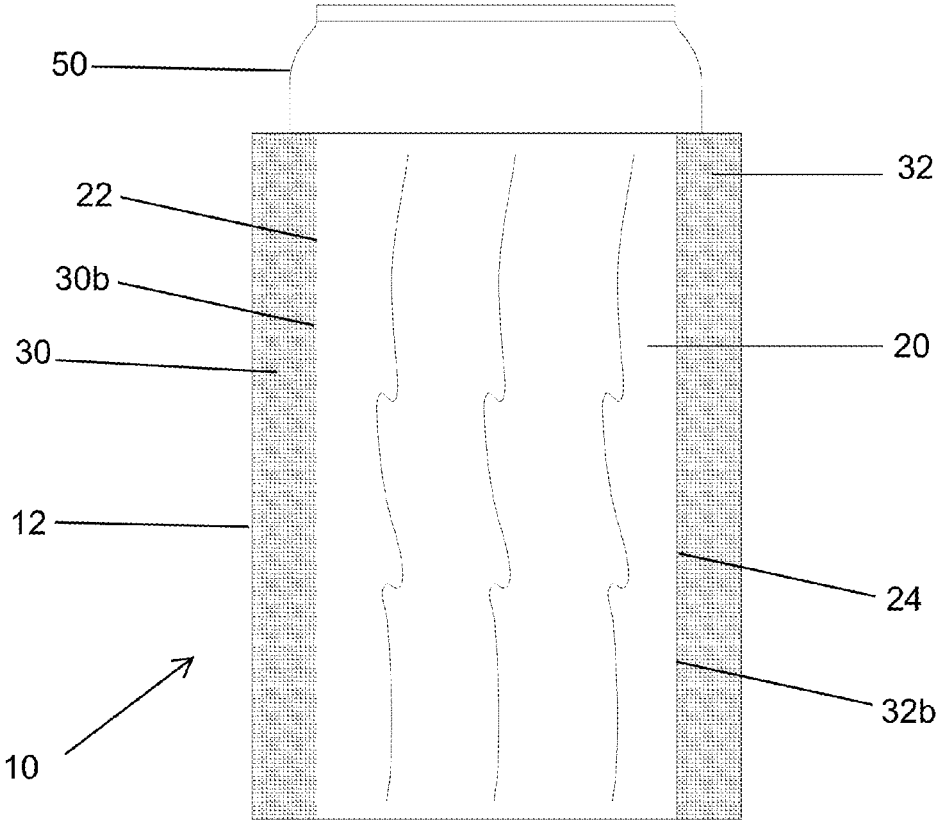
FIG. 1 shows a front view of an apparatus according to a first embodiment of the invention, holding a beverage without a phone in the phone compartment.

The present invention will now be described, with reference made to FIGS. 1-10.

An apparatus 10 in the form of a hand held, insulated beverage and mobile device holder, is provided for storing both a beverage 50 and mobile device 60. The apparatus 10 includes a cylindrical housing 12 to receive a beverage 50, and a compartment 40 to receive a mobile device 60. The apparatus 10 thereby allows a user to hold his or her beverage 50 and mobile device 60 in one hand and simultaneously access the mobile device 60 with the other free hand.

The apparatus 10 includes a cylindrical housing 12, which is configured to receive a beverage 50 in a bottle, can or cup, for example, and insulate the beverage 50. At least one round or circular end of the cylindrical housing 12 is open to receive the beverage 50. In a preferred embodiment, the end of the cylindrical housing 12 opposing the open end is provided with a base section 16 to close the opposing end, in whole or in part. In a preferred embodiment, the base section 16 can be round or circular, so as to substantially cover the entire open bottom end of the cylindrical housing 12 when the beverage 50 is inserted in the cylindrical housing 12. This prevents the beverage 50 from falling through the cylindrical housing 12. However, in alternative embodiments, the base section 16 can be in the form of a substantially rectangular strip spanning the open bottom end of the cylindrical housing 12 to cover a central portion of the open bottom end of the cylindrical housing 12 when the beverage 50 is inserted in the cylindrical housing 12. It is further envisioned that in further alternative embodiments, the cylindrical housing 12 does not include a base section 16, and is open on both circular ends. In such an embodiment, the constriction of the cylindrical housing 12 around the beverage 50 secures the beverage 50 within the cylindrical housing 12.

Figure 7:
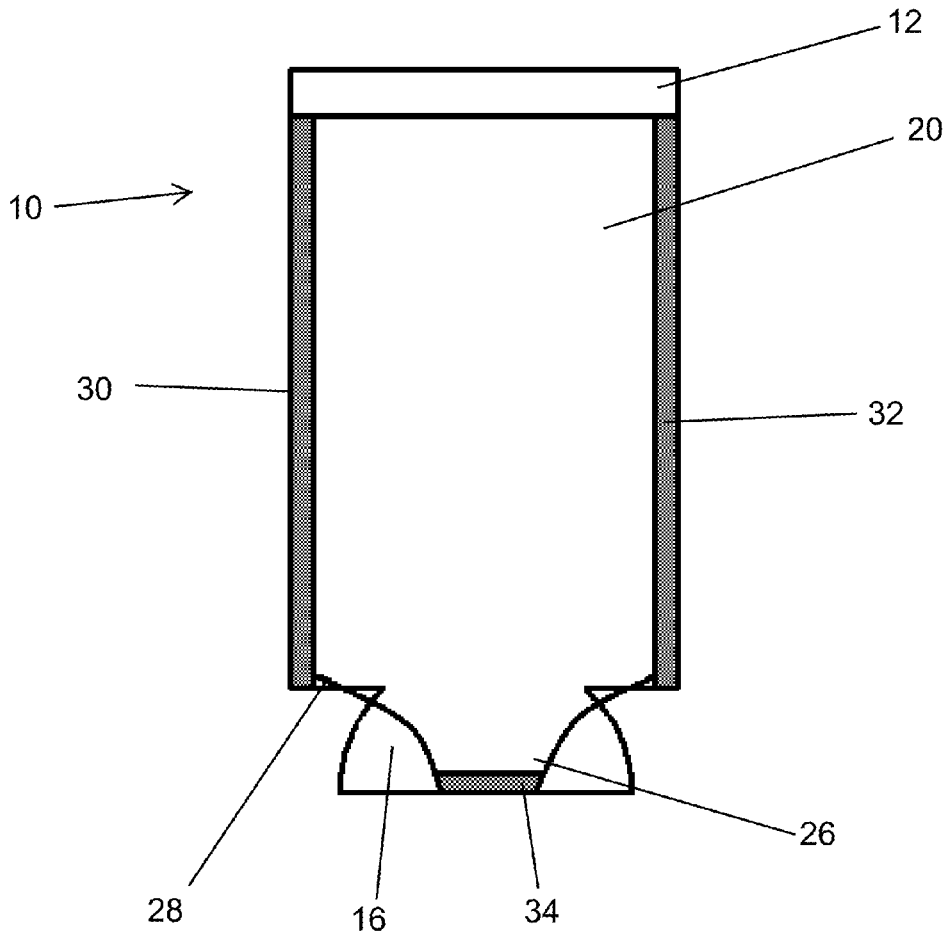
FIG. 7 shows a folded view of the apparatus according to the first embodiment of the invention.

The cylindrical housing 12 can be made from any insulating material that is known in the art for use with a beverage holder, including for example foam, neoprene and other synthetic materials. The insulating material is preferably also sufficiently pliable, such that the cylindrical housing 12 can be flattened when it does not contain a beverage 50, as shown in FIG. 7. The size of the cylindrical housing 12 can vary so as to fit differently sized containers, such as a bottle, can or beverage glass. The cylindrical housing 12 securely holds the beverage 50 by constricting around the beverage 50.

The cylindrical housing 12 can be formed from one or more piece of the insulating material. For example, the entire cylindrical housing 12, including base section 16, can be formed from a single piece of insulating material. The insulating material can be folded or rolled, and sewn closed along one or more side seam 14*a* and 14*b*. A similar method can be used for forming the cylindrical housing 12 from two or more pieces of insulating material.

The apparatus 10 further includes a mobile device compartment 40, which is formed between the cylindrical housing 12, a transparent member 20 and elastic members 30 and 32.

Figure 2:
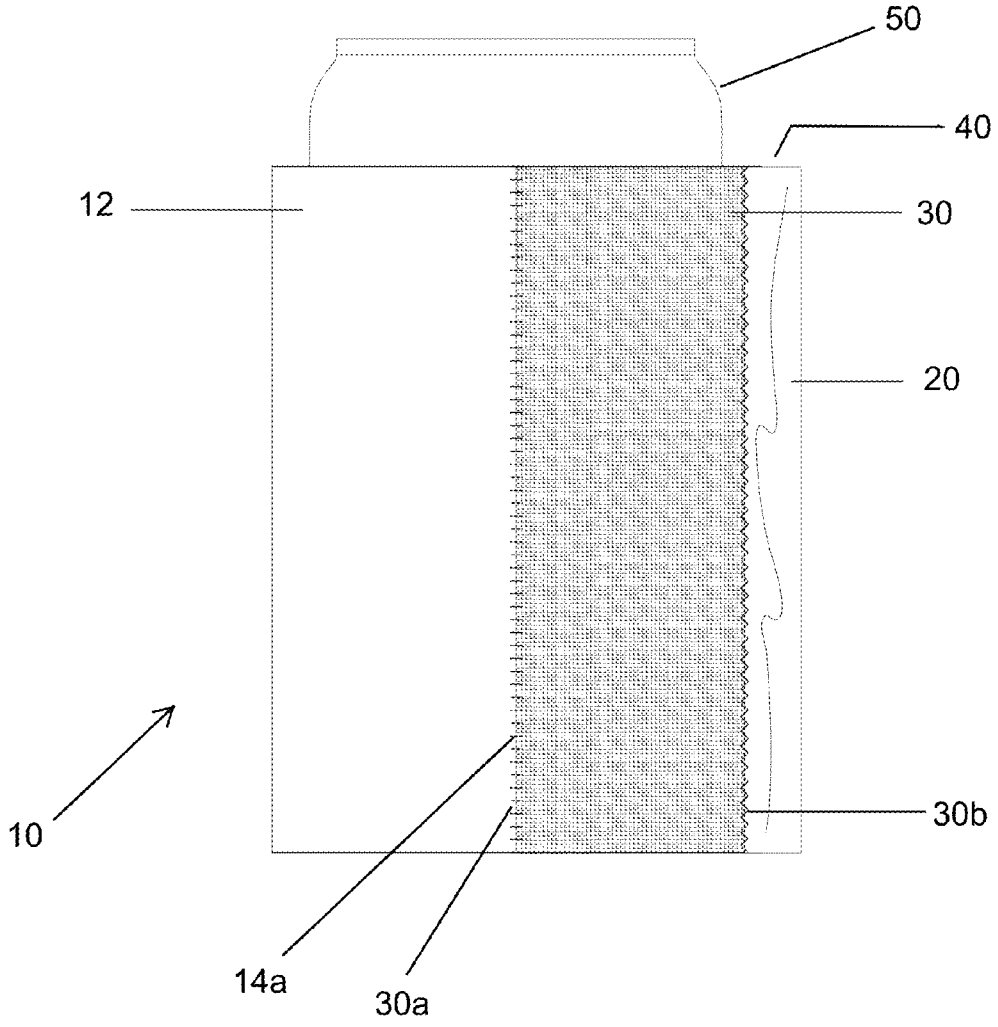
FIG. 2 shows a side view of the apparatus according to the first embodiment of the invention, holding a beverage without a phone in the phone compartment.
Figure 3:
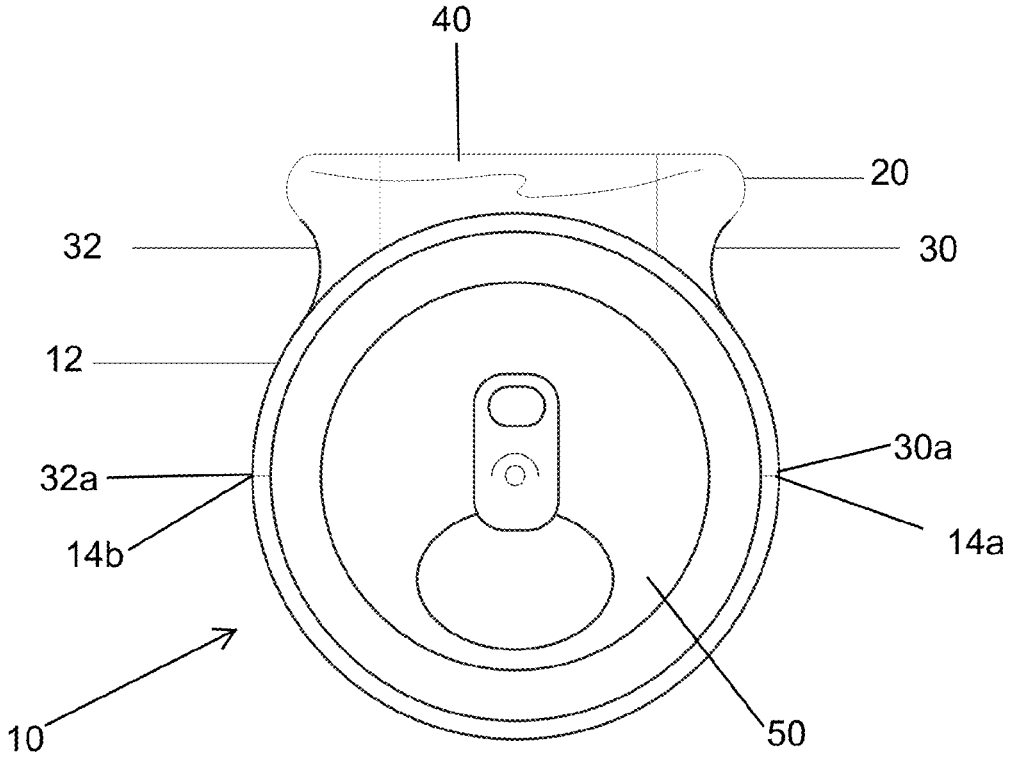
FIG. 3 shows an overhead view of the apparatus according to the first embodiment of the invention, holding a beverage without a phone in the phone compartment.
Figure 4:
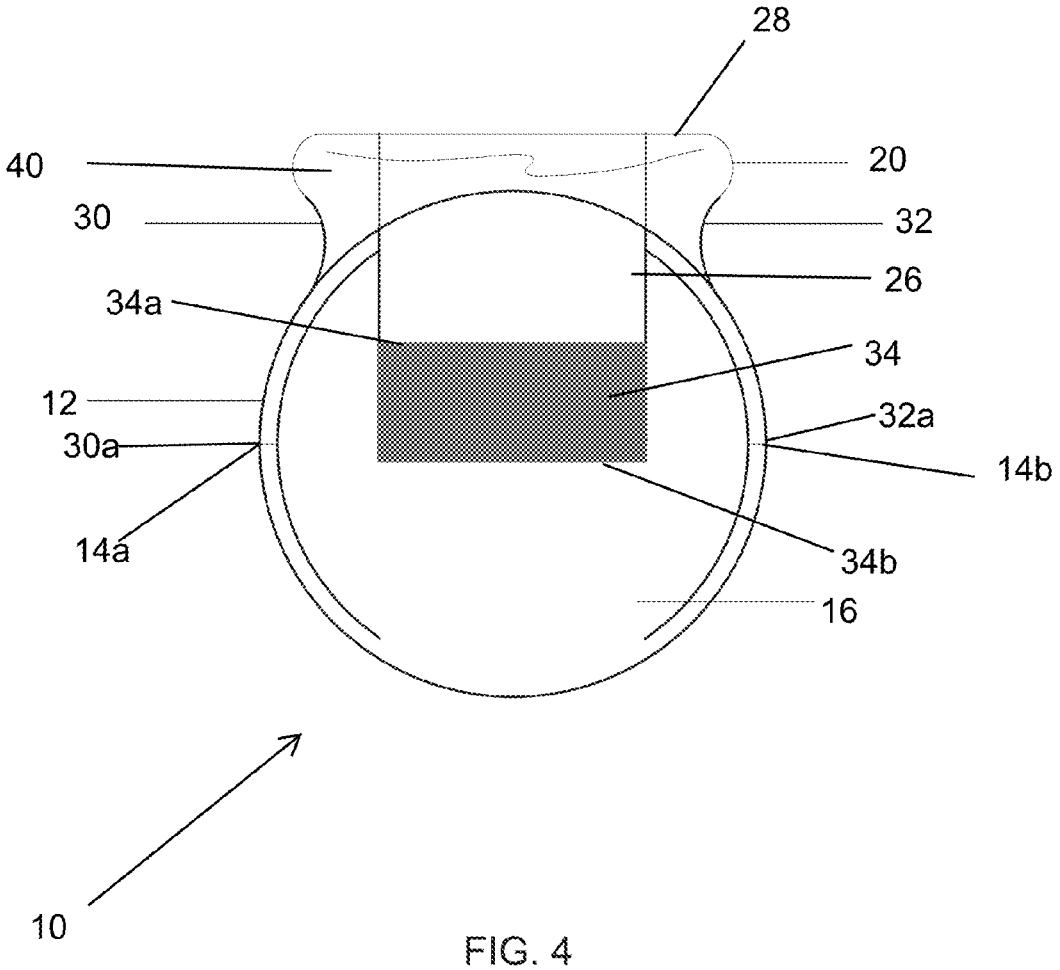
FIG. 4 shows an underside view of the apparatus according to the first embodiment of the invention, holding a beverage without a phone in the phone compartment.
Figure 5:
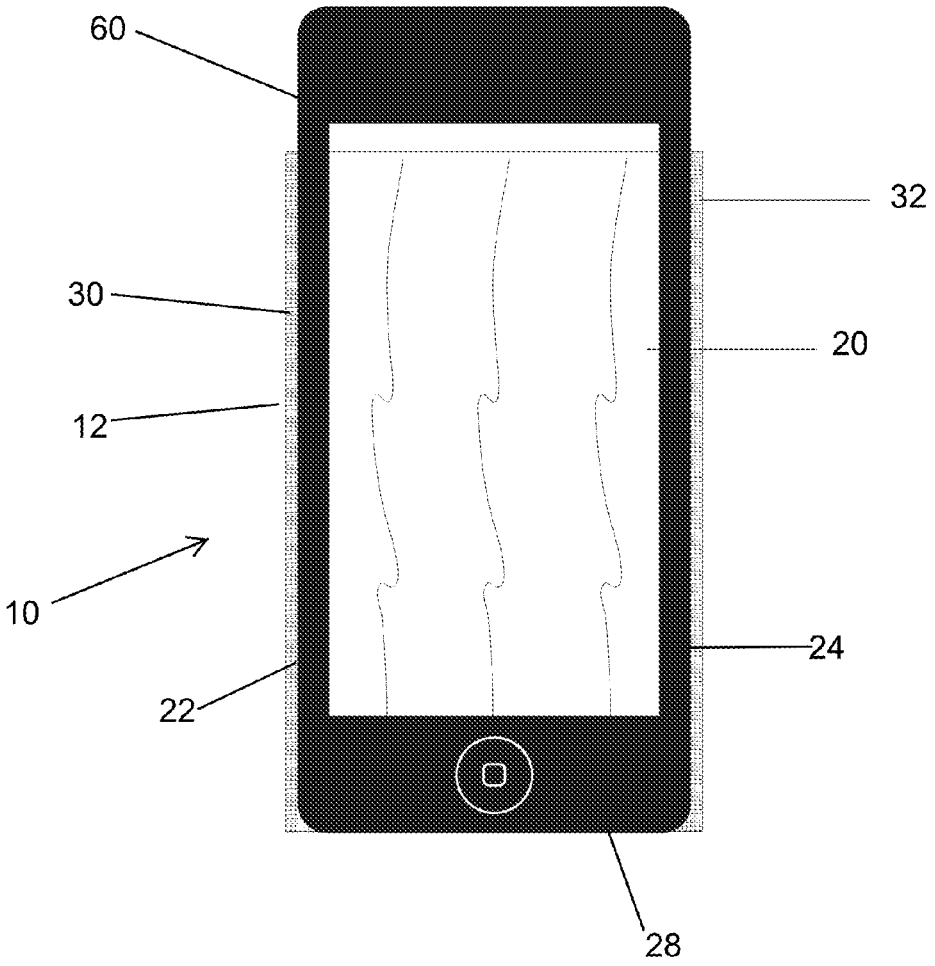
FIG. 5 shows a front view of the apparatus according to the first embodiment of the invention, holding a beverage and including a phone in the phone compartment.
Figure 6:
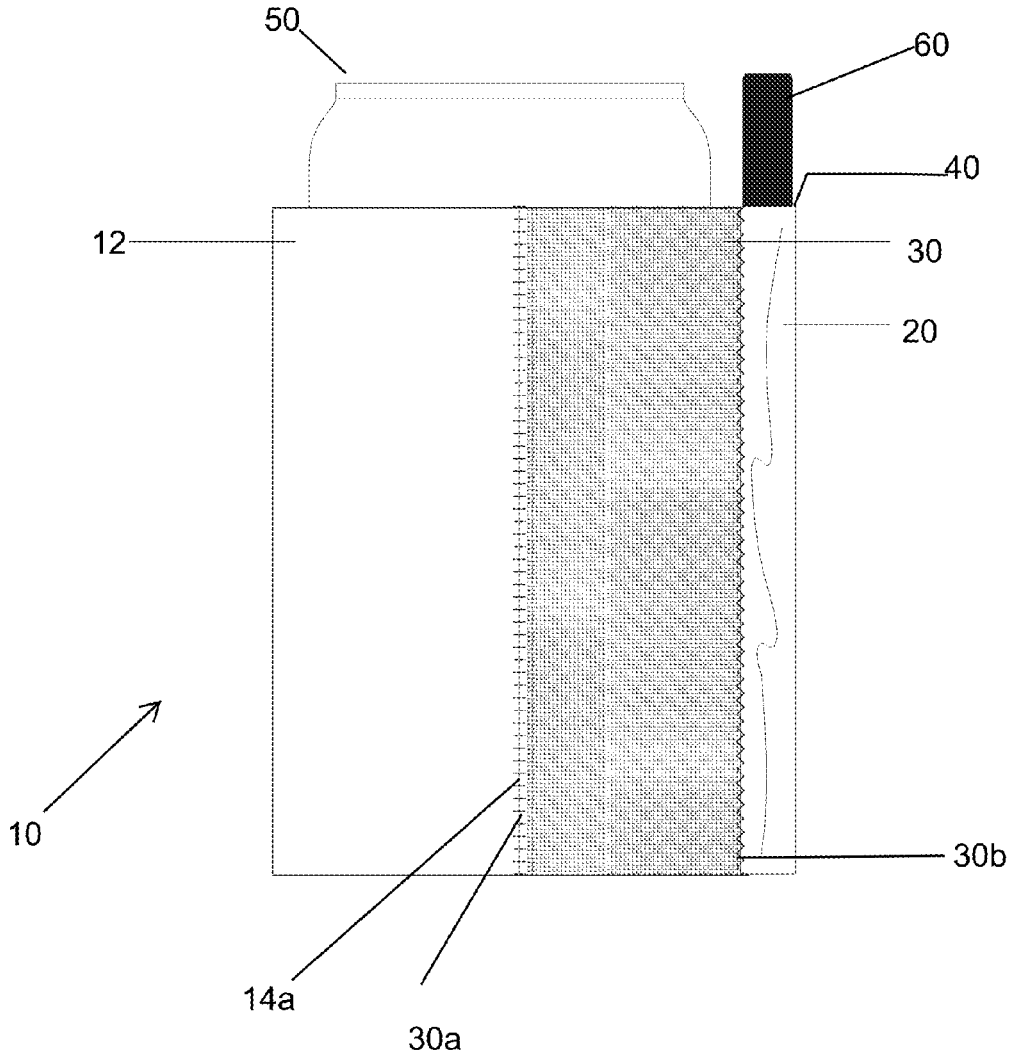
FIG. 6 shows a side view of the apparatus according to the first embodiment of the invention, holding a beverage and including a phone in the phone compartment.

The elastic members 30, 32 are preferably strips of a highly elastic material, including for example synthetic, spandex materials. The elastic members 30 and 32 are each attached to the cylindrical housing 12 by a seam running through the cylindrical housing 12 and a first side edge 30*a*, 32*a* of each of the elastic members 30, 32, as shown in FIGS. 2 and 6 for example. In a preferred embodiment, the first side edges 30*a*, 32*a* of the elastic members 30, 32, are aligned with the side seams 14*a*, 14*b* in the cylindrical housing 12 so that the same seams 14*a*, 14*b* are used to close the cylindrical housing 12 and attach the elastic members 30, 32 to the cylindrical housing 12. This reduces the number of apparent seams in the apparatus 10. However, in alternative embodiments, the elastic members 30, 32 can be attached to the cylindrical housing 12 using separate seams.

The transparent member 20 is secured to the cylindrical housing 12 of the apparatus 10 by attachment to the elastic members 30, 32. In a preferred embodiment, the transparent member 20 is attached to the elastic members 30, 32, prior to attaching the transparent member 20 and elastic members 30, 32 to the cylindrical housing 12. The side edges 22, 24 of the transparent member 20 are attached to second side edges 30*b*, 32*b* of the elastic members 30, 32 by seams. The elastic members 30, 32 can then be attached to the cylindrical housing 12 as described above, which secure the transparent member 20 to the cylindrical housing 12.

In a preferred embodiment, the apparatus 10 comprises a sealing element positioned near the base of the apparatus 10, to seal an otherwise open space between the cylindrical housing 12 and bottom edge 28 of the transparent member 20. This prevents the mobile device 60 from falling through the base of the compartment 40. In a preferred embodiment, the sealing member is a third elastic member 34, which is attached to the cylindrical housing 12 and to a tab 26 projecting from a bottom edge 28 of the transparent member 20. The third elastic member 34 is attached to the transparent member 20 by a first seam 34*a* and is attached to the base 16 of the cylindrical housing by a second seam 34*b*. This closes the bottom of the compartment 40, which prevents a mobile device 60 in the compartment from falling through the bottom.

Figure 9:
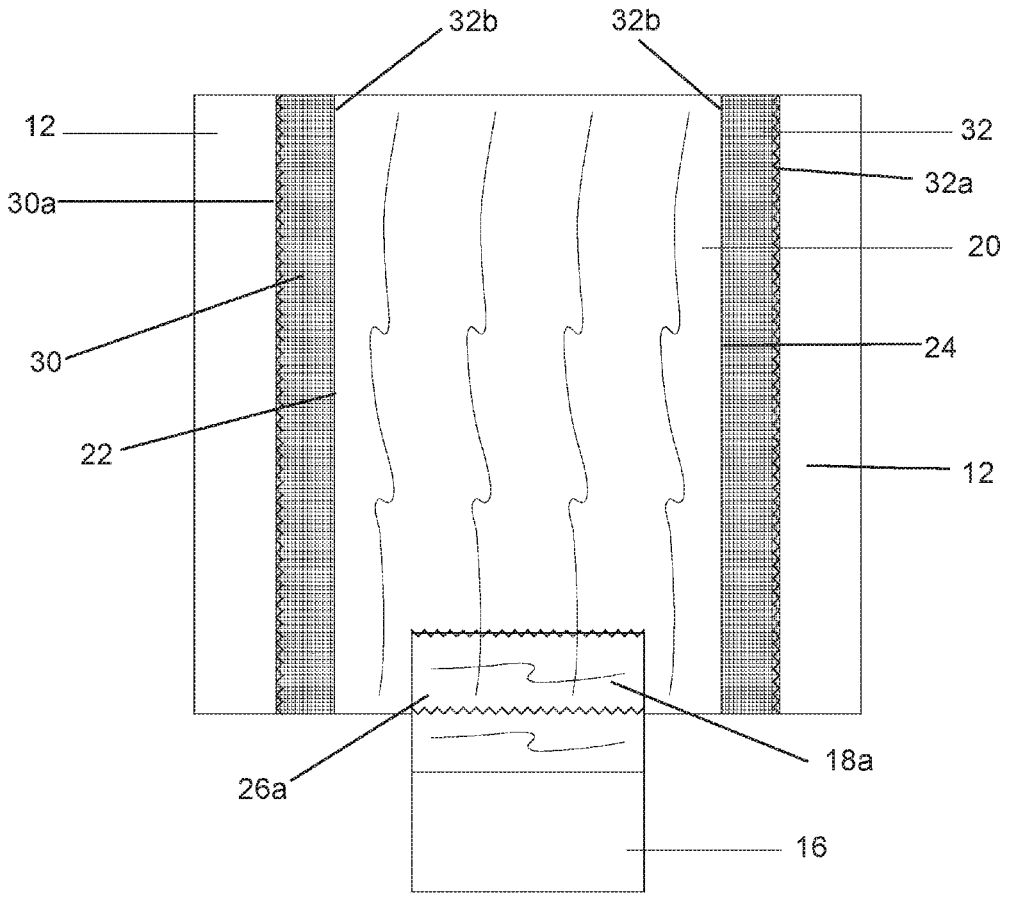
FIG. 9 shows a deconstructed view of the apparatus according to a further embodiment of the invention.
Figure 10:
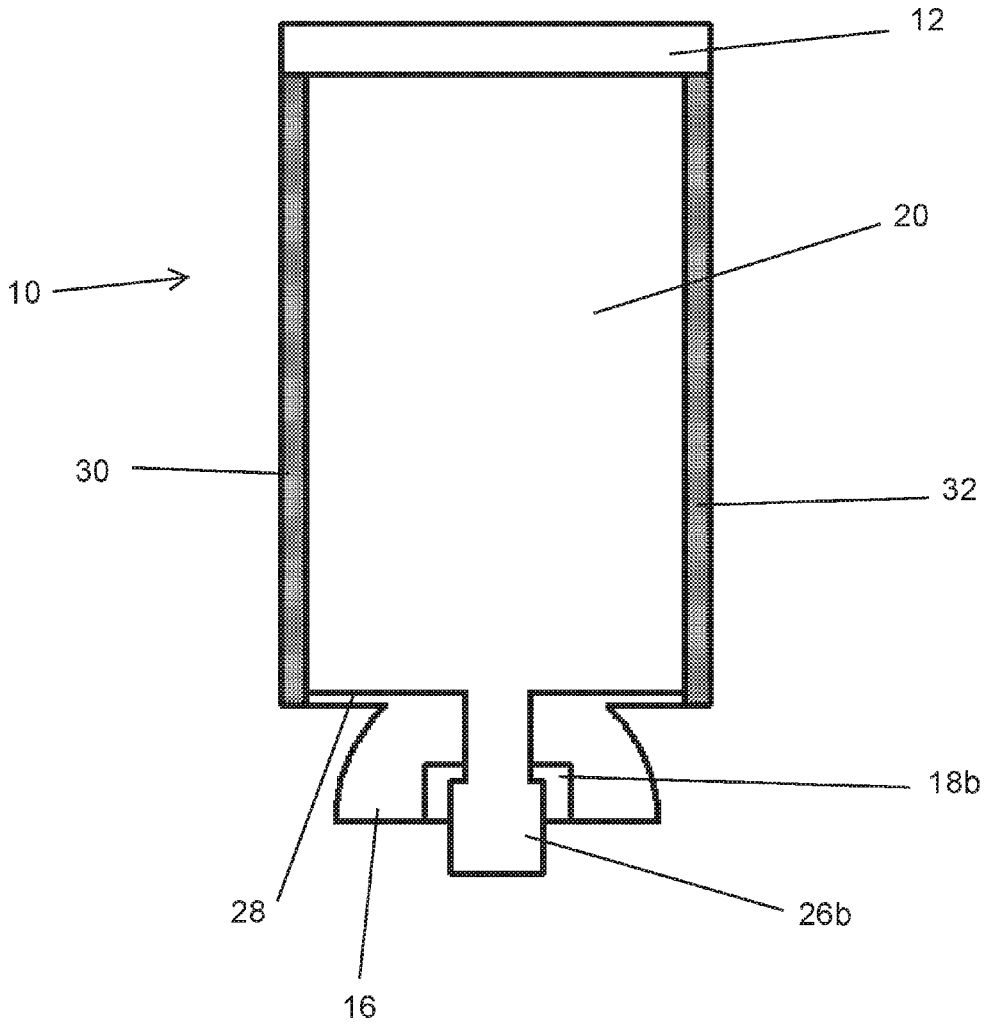
FIG. 10 shows a folded view of the apparatus according to a further embodiment of the invention.

In an alternative embodiment, shown in FIG. 9, a sealing member 18*a* is placed on or near the base section 16 of the cylindrical housing 12 and mates with a corresponding sealing member 26*a* positioned on the transparent member 20, near the bottom edge 28. In a further alternative embodiment, shown in FIG. 10, a sealing member 26*b* extends from the bottom edge 28 of transparent member 20 and mates with a corresponding sealing member 18*b* positioned on the base section 16 of the cylindrical housing 12. In embodiments of the apparatus 10 where the cylindrical housing 12 does not include a base section 16, the sealing member 26*b* can mate with a corresponding sealing member on the inner surface of the cylindrical housing 12 or on the outer surface of the cylindrical housing 12. In such embodiments, the sealing members 18*a*, 18*b*, 26*a*, 26*b* can be any appropriate corresponding pair of sealing members known in the art, including for example hook and loop fasteners, snaps, tabs and slots, zippers, clasps, laces or ties.

During operation of the apparatus 10, a mobile device 60 can be placed into the compartment 40 formed between the cylindrical housing 12, a transparent member 20 and elastic members 30 and 32. Placing the mobile device 60 in the compartment 40 causes the elastic members 30 and 32 to stretch and the compartment 40 to expand in width (i.e., expand the amount of space between the cylindrical housing 12 and transparent member 20). The compartment 40 expands to the appropriate width so that the mobile device 60 will be constricted within the compartment 40. In this manner, the compartment 40 can be used in connection with different mobile devices 60 having different sizes.

The transparent member 20 is made from a thin, plastic material. The material is preferably designed to allow a user to see the screen of a mobile device 60 and to operate a touch screen of the mobile device 60, through the transparent member 20. In certain embodiments, the transparent member 20 may comprise one or more openings which align with input ports on a mobile device 60, such as those for receiving headphones or speakers, or a power source.

The apparatus 10 can be assembled according to one or more methods. According to a preferred embodiment, the transparent member 20 is attached to the elastic members 30, 32, 34 as described above. A piece of insulating material as described above is provided for the formation of the cylindrical housing 12, which can be shaped as having two rectangular sections separated by a circular section. The insulating material is folded in half (into the shape shown in the folded view of the apparatus 10 in FIG. 7), and the transparent member 20 with attached elastic members 30, 32, 34 positioned inside the folded insulating material. The openings between the fold of the insulating material are closed by side seams 14*a*, 14*b*, which also attach the elastic members 30, 32 to the cylindrical housing 12. The apparatus 10, which is inside out at this point with the transparent member 20 oriented on the interior of the cylindrical housing 12, can be inverted to position the formed compartment 40 on the outside of the cylindrical housing 12. The third elastic member 34 can be attached to the base section 16 of the cylindrical housing 12 with a seam 34*b* before the insulating material is first folded or after the apparatus has been inverted. This is not the only method that may be used for assembling the apparatus 10, but alternative methods can be used arranging the steps described above in alternate order, or placing various seams in different positions on the apparatus 10.

As shown for example in FIG. 7, in addition to the features set forth above, the apparatus 10, when not in use, is collapsible to a flattened shape, so that it can be stored.

The present invention is not limited to use with one particular type of mobile device, but can be used with any number of mobile phones, smart phones, portable music players, etc.

Figure 8:
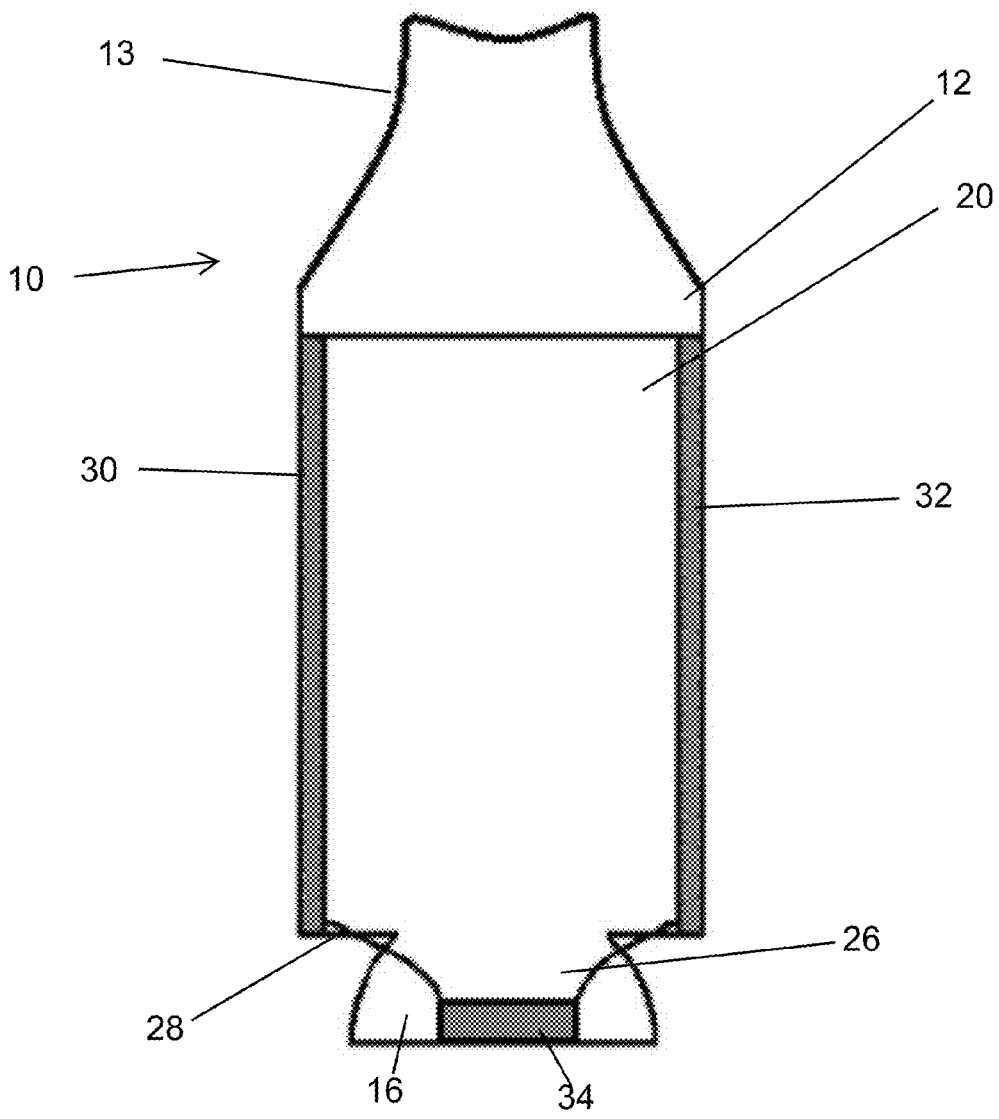
FIG. 8 shows a folded view of an apparatus according to a second embodiment of the invention.

As previously mentioned, it is further envisioned that the mobile device and beverage holding apparatus according to the invention can take other forms departing from the embodiment shown in FIGS. 1-7. According to a second embodiment of the invention, an alternatively shaped apparatus 10 is provided, as shown in FIG. 8. In contrast to the substantially can-shaped apparatus 10 shown in FIGS. 1-7, the apparatus 10 shown in FIG. 8 is bottle-shaped. The apparatus 10 comprises a cylindrical housing 12 having a base section 16, transparent member 20 with tab 26 projecting from the base 28 and elastic members 30, 32, 34. The cylindrical housing 12 has a neck section 13, making the apparatus 10 substantially bottle-shaped. The neck section 13 may comprise a closing element, such as a zipper (not shown), which can be opened to increase the size of the neck section 13 for receiving a bottle, and closed to further secure the bottle within the apparatus 10.

In a further alternative embodiment, the apparatus can be provided where a single piece of elastic material is attached to the transparent member on both sides of the transparent member, creating a closed loop. The transparent member and attached elastic material can be attached to a smaller piece of insulating material, which is only provided behind the transparent member to create a compartment for receiving a mobile device. Thus, instead of providing an insulating material that is folded into a cylindrical shape, the cylindrical shape is formed in part by a combination of insulating material and elastic material. This embodiment provides a more flexible apparatus that can be used to fit varying sizes of containers, such as cans or cups, as a substantial element of the beverage holding element of the apparatus is formed by elastic material.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An apparatus comprising:

a cylindrical housing configured to receive a cylindrical container and comprising a base section configured to cover one round end of the cylindrical housing;

a first elastic member secured to the cylindrical housing along a first edge of the first elastic member;

at least a second elastic member secured to the cylindrical housing along a first edge of the second elastic member;

a transparent member having a first edge secured to a second edge of the first elastic member and a second edge secured to a second edge of the at least second elastic member; and a third elastic member attached to the transparent member on one edge and attached to the base section of the cylindrical housing on another edge and configured to seal a third, base edge of the transparent member to secure the mobile device in the compartment;

wherein a compartment for receiving a mobile device is formed between the transparent member and the cylindrical housing that is configured to expand away from the cylindrical housing by extending the elastic members, and wherein the transparent member is formed from a transparent material configured to permit operation of a touch screen on the mobile device positioned beneath the transparent material by a user making contact with the transparent material.

2. The apparatus of claim 1, wherein the apparatus is collapsible to a substantially flat arrangement.

3. The apparatus of claim 1, wherein the cylindrical housing is formed from a flexible, temperature insulating material.

4. The apparatus of claim 3, wherein the first and second elastic members are formed from a highly flexible synthetic material that is different from the flexible, temperature insulating material forming the cylindrical housing.

5. The apparatus of claim 1, wherein the cylindrical housing is formed from a single sheet of a flexible, temperature insulating material folded and seamed together by two side seams to form a cylindrical shape.

6. The apparatus of claim 5, wherein the first and second elastic member are attached to the cylindrical housing by the two side seams.

7. An apparatus comprising:

a cylindrical housing configured to receive a cylindrical container and comprising a base section configured to cover one round end of the cylindrical housing;

a first elastic member secured to the cylindrical housing along a first edge of the first elastic member;

at least a second elastic member secured to the cylindrical housing along a first edge of the second elastic member;

a transparent member having a first edge secured to a second edge of the first elastic member and a second edge secured to a second edge of the at least second elastic member;

a sealing element configured to seal a third, base edge of the transparent member to secure the mobile device in the compartment, wherein the sealing element comprises a first sealing element on the transparent member and a second sealing element on the cylindrical housing and configured to mate with the first sealing element;

wherein a compartment for receiving a mobile device is formed between the transparent member and the cylindrical housing that is configured to expand away from the cylindrical housing by extending the elastic members, and wherein the transparent member is formed from a transparent material configured to permit operation of a touch screen on the mobile device positioned beneath the transparent material by a user making contact with the transparent material.

8. The apparatus of claim 7, wherein the second sealing element is positioned on the base section of the cylindrical housing.

9. The apparatus of claim 7, wherein the second sealing element is arranged on an interior surface of the cylindrical housing.

10. The apparatus of claim 7, wherein the first and second sealing elements comprise corresponding hook and loop fasteners.

11. The apparatus of claim 1, wherein the transparent member further comprises one or more openings configured to provide access to input ports on the mobile device.

12. The apparatus of claim 1, further comprising a neck section projecting from the cylindrical housing having a minimum diameter less than a diameter of the cylindrical housing.

13. The apparatus of claim 1, wherein the cylindrical housing is formed in part by an insulating material and in part by a more flexible elastic material.

14. A method for creating a beverage and mobile device holding apparatus comprising:

attaching a first edge of a transparent member to a first elastic member;

attaching a second edge of the transparent member to a second elastic member;

folding a piece of a temperature insulating material;

positioning the transparent member and first and second elastic members inside the folded temperature insulating material;

attaching the transparent member and first and second elastic members to the temperature insulating material;

sealing the folded piece of temperature insulating material on at least two edges providing a side seam through each of the at least two edges;

inverting the sealed temperature insulating material to provide a cylindrical housing configured to receive a container and an expandable compartment configured to receive a mobile device between the transparent member and the cylindrical housing wherein the transparent member and first and second elastic member are attached to the temperature insulating material by providing the side seams also through each of the elastic members, with one elastic member being arranged on each of the at least two edges of the temperature insulating material;

providing a third elastic member;

attaching the third elastic member to a third base edge of the transparent member; and attaching the third elastic member to the temperature insulating material.

15. The apparatus of claim 7, wherein the apparatus is collapsible to a substantially flat arrangement.

16. The apparatus of claim 7, wherein the cylindrical housing is formed from a flexible, temperature insulating material.

17. The apparatus of claim 16, wherein the first and second elastic members are formed from a highly flexible synthetic material that is different from the flexible, temperature insulating material forming the cylindrical housing.

18. The apparatus of claim 7, wherein the transparent member further comprises one or more openings configured to provide access to input ports on the mobile device.

19. The apparatus of claim 7, further comprising a neck section projecting from the cylindrical housing having a minimum diameter less than a diameter of the cylindrical housing.

* * * * *